United States Patent [19]

Luczynski

[11] Patent Number: 4,993,704

[45] Date of Patent: Feb. 19, 1991

[54] SKI SLALOM EXERCISER

[76] Inventor: Kazimierz Luczynski, 127 Spyglass Hill Road, Concord, Ontario, L4K 2K6, Canada

[21] Appl. No.: 178,435

[22] Filed: Apr. 7, 1988

[30] Foreign Application Priority Data

Apr. 10, 1987 [CA] Canada ..... 527458

[51] Int. Cl.[5] ..... A63B 69/18

[52] U.S. Cl. ..... 272/97; 434/253

[58] Field of Search ..... 272/70, 97, 69, 144–146; 434/253

[56] References Cited

U.S. PATENT DOCUMENTS 3,582,066 6/1971 Kerylak ..... 272/97
3,591,172 7/1971 Hude ..... 272/97

FOREIGN PATENT DOCUMENTS 2515570 10/1976 Fed. Rep. of Germany ..... 272/97
1516075 3/1968 France ..... 272/97
0368760 3/1939 Italy ..... 272/97

*Primary Examiner*—Stephen R. Crow

[57] ABSTRACT

A ski slalom exerciser which includes a horizontal platform with a low friction top surface and a pair of sliders having low friction bottoms disposed on the platform for sliding movement thereon. This movement may also be guided by a pair of elongated guides slidably engaged to the sliders. The guides positioned and extending above the platform have their forward ends pivotally secured to a bracket positioned forwardly in variable distance from the platform. To stop this movement, the sliders have on their elongated lateral sides brakes operated by tilting the user's feet. A pair of upright adjustable poles are mounted to the front portion of the base in variable distance from the platform. A pair of stretchable straps may be used to compel the user to flex his legs. The straps are attached at one end to hooks at the front of the sliders, with the other end wrapped around the user's knees.

6 Claims, 1 Drawing Sheet

SKI SLALOM EXERCISER

BACKGROUND OF THE INVENTION

This invention relates to an apparatus for use in learning and/or practicing snow skiing techniques.

The most important maneuvering in snow skiing is making controlled turns of skis to achieve a desired direction of travel and/or to vary the speed of travel. There are certain ski techniques, with which a skier should be familiar in order to have complete control of his skis. These techniques can be practiced on an exerciser which can simulate conditions experienced in snow skiing.

There is a great variety of ski exercise equipment that allows a trainee to practice ski techniques. However, there is no available equipment that allows freedom of feet movement that a skier experiences in actual skiing. They do not provide means for the skier's hands to be supported, nor means to compel him to keep his knees and ankles in a flexed position.

PURPOSE OF THE INVENTION

It is a principal object of the present invention to provide an exerciser which can simulate to a high degree snow skiing conditions.

It is another object of the present invention to provide an exerciser which allows a user to practice many ski techniques and work-out a desired body pressure.

It is still another object of the present invention to provide an exerciser which is simple in construction, inexpensive, and which may easily be disassembled for convenient storage.

Further and other objectives will be apparent to a person skilled in the art following the summary and detailed description of the invention.

SUMMARY OF THE INVENTION

The ski slalom exerciser of the present invention has a horizontal platform mounted proximate the rear portion of the base preferably made of tubular members with a low friction top surface. A pair of sliders having bindings mounted proximate the top thereof for securing the user's feed thereto are disposed on the platform for sliding movement thereon. To facilitate this movement, the bottoms of the sliders are covered with low friction cushions. To execute a controlled stop of this sliding movement at any desired moment, break means are provided on the sliders which operate by the user tilting his feet to one side or the other.

Alternatively, for some ski techniques a pair of elongated guides may be applied. The guides are slidable engaged to the sliders. The forward ends of said elongated guides are pivotally mounted to a bracket which is preferably displaced forwardly in variable distance from the platform, and secured to the base. This position determines an angle of pivotal movement of the guides and thereby movement of the sliders.

A stretchable tether coupling both guides may also be applied to urge a user to keep his feet together.

Furthermore, a pair of stretchable straps may be used to compel the user to flex his ankles and knees. The straps are attached, at one end thereof to hooks at the front of said sliders, with the other end thereof wrapped around the user's knees.

A pair of upright poles are mounted proximate the front portion of the base. The distance between the poles and the platform, and the height of poles may be varied to accommodate various body sizes.

Other objects of the invention will appear in the following description and appendent claims reference being made to the accompanying drawings forming a part of the specification wherein like reference numerals designate corresponding parts in the several views.

The ski slalom exerciser, in its basic arrangement, operates as follows: a user attaches hit feet to the sliders, grasps the handle grips on the poles, and moves the sliders the same way as he would move his skis in actual skiing.

DESCRIPTION OF SPECIFIC EMBODIMENT

Figure 1:
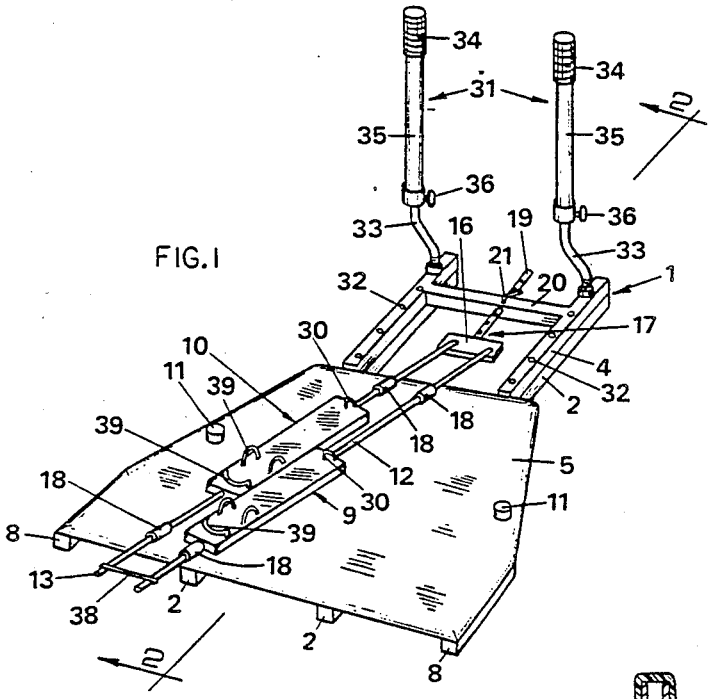
FIG. 1 is a front perspective view of an exerciser in one embodiment of the present invention.
Figure 2:
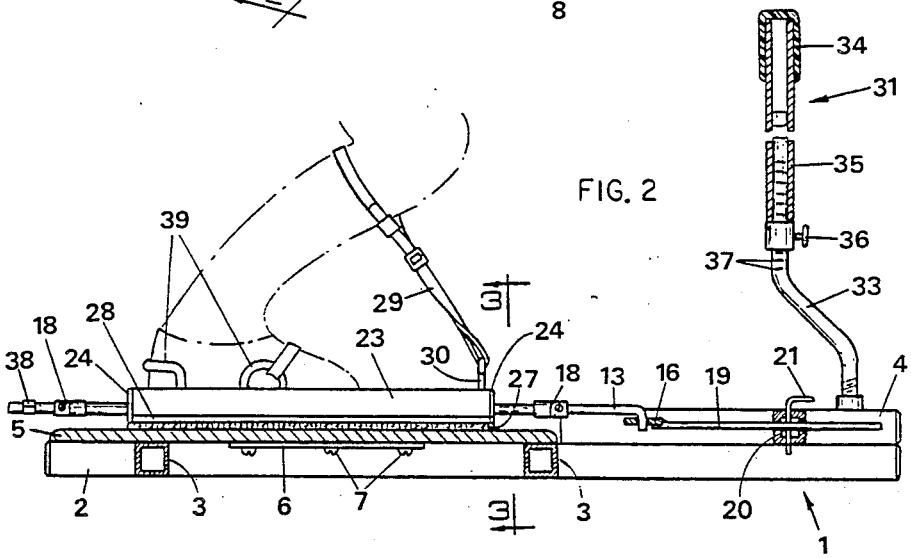
FIG. 2 is a right side cross section elevational view thereof along line 2—2 of FIG. 1.

Referring now to the drawings, the exerciser has a base generally shown as 1. The base 1 may be made of rigid tubular members comprising two elongated main members 2, and at least one cross brace 3. The members 2 and cross braces 3 are permanently joined together. To reinforce the front portion of the base 1, an H-shaped frame 4 made also of permanently joined rigid tubular members is secured to the front portion of base members 2, so that the rear ends of the frame 4 provide an abutment to the front edge of a platform 5 which is mounted to the rear portion of the base 1 with a bracket 6 and screws 7.

The platform 5 has a low friction top surface and round upper edges. For stability of the platform 5, a lateral support 8 is mounted along both lateral portions underside to the platform 5.

A pair of sliders 9 and 10 are disposed on the platform 5 for slide movement thereon, and two abutment means 11 are mounted on the top surface lateral portions of the platform 5 to prevent sliders 9 and 10 from sliding off the platform 5 accidentally.

A pair of elongated guides 12 and 13 positioned and extending above the platform 5, through openings 14 and 15 are slidably engaged to the sliders 9 and 10 for their movement along the guides. Forward ends of guides 12 and 13 are pivotally mounted to a web 16 of bracket means 17. The web 16 is positioned forwardly in variable distance from the platform 5, to permit variation in an angle of pivotal movement of guides 12 and 13. To select a desired length of slider's movement along the guides, restricting means 18 are mounted on the guides 12 and 13 at both ends of each slider 9 and 10.

Bracket means 17 comprise a web 16 secured to a stem 19 which is inserted through an horizontal opening in the center of the cross brace 20, where said stem 19 is kept in place by a retainer pin 21 inserted through a vertical opening the cross brace 20 to engage with one of a plurality of vertical openings formed in the stem 19 as best shown in FIG. 1.

Figure 3:
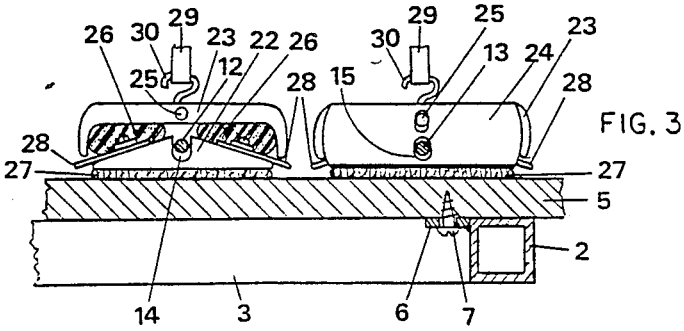
FIG. 3 is a cross section elevational view thereof along line 3—3 of FIG. 2.

Sliders 9 and 10 each comprise a base member 22 and a top cover member 23. Both said members are tiltably mounted together with a mounting plate 24 and a sliding pin 25 secured to respective ends of said members as shown on FIG. 3.

A resilient means 26 is interposed between said base member 22 and said top cover member 23 resiliently preventing the top cover member 23 against being tilted unintentionally by the user. The cushions 27 are made of a low friction material that is compatible with the low friction top surface of the platform 5, and this compatibility facilitates the sliding movement of sliders 9 and 10 on the platform 5.

To execute a controlled stop of moving sliders 9 and 10 on the platform 5 in any desired moment, each said slider comprises two flexible friction plates 28 secured to the elongated lateral portions of the base member 22. The plates 28 extend outwardly beyond the lateral edges of the base member 22. The top cover member 23 has an inverted U-shaped cross section with elongated lateral portions protruding downwardly above the extending portions of the plates 28, and by tilting the cover member 23 by a user's foot, one of the protruding downwardly lateral portions of the cover member presses against the extending portion of the friction plate 28 thereby causing the contact of the friction plate 28 with the platform 5. This contact creates friction between sliders 9 and 10 and the platform 5 and thus stops the movement of sliders 9 and 10.

A pair of stretchable straps 29 are provided to compel the user to flex his knees and ankles. One end of each strap 29 is removably attached to a hook 30 which is located at the front end of the sliders 9 and 10, and the other end is wrapped around the user's knees. The strap 29 comprises conventional buckles for adjusting the size of the knee embracing loop, as well as to vary the desired length between the knee and the hook 30.

A pair of upright poles generally shown as 31 are removably mounted in one pair of a plurality of vertically extending openings 32 formed in the front portion of base embers 2 and the frame 4. A selection of openings 32 varies the distance between the poles 31 and the platform 5. Each pole 31 comprises a support rod 33 having an upper portion offset in a parallel manner relative to a lower pile portion which is removably mounted in one of the vertical openings 32. This offset facilitates selection of spacing between poles when rotated clockwise or counter clockwise. The pole 31 further comprises a hand grip 34 mounted proximate the upper end portion of pipe member 35, and the lower portion of pipe member 35 is telescopically engaged to the upper portion of the support rod 33, and this engagement may be secured in selected positions by means 36.

A linear scale 37 in even intervals in engraved on the upper portion of the support rod 33 to facilitate selection of a desired length of poles 31./

A stretchable tether 38 is removably attached to rear portions of the guides 12 and 13 to compel the user to keep said guides in parallel manner and thereby to keep sliders 9 and 10 closer together.

Bindings generally shown as 39 are mounted on the top of each slider 9 and 10 for securing the feet of the user thereto.

I claim:

1. A ski slalom exerciser comprising a base disposed on a floor, a horizontal platform having a low friction top surface, mounted upon a rear portion of said base, a pair of sliders having low friction bottoms disposed on said platform for sliding movement thereon, a pair of adjacent elongated guides positioned and extending above said platform having forward ends pivotally secured to bracket means displaced forwardly in a variable distance from said platform; middle portions of said guides extending into center openings of said sliders slidably engaging thereof to guide said movement; and a stretchable tether removably coupling rear portion of said guides for maintaining and slides in close proximity, a pair of stretchable straps each with one end removably attached proximate the forward portions of said sliders, and the other ends of said straps embracing the knees of a user, a pair of upright poles with variable length mounted proximate the forward portion of said base in variable distance from said platform.

2. A ski slalom exerciser according to claim 1 in which said horizontal platform comprises two abutment means secured to lateral portions of the platform, and the pair of said sliders having low friction cushions secured to their bottoms and disposed upon said platform for sliding movement thereon.

3. A ski slalom exerciser according to claim 2 wherein said sliders each comprise a top cover member tiltably mounted with mounting means to a base member, said mounting means secured to end portions of said members, and resilient means interposed between said members resiliently urge said top cover member against tilting relative to said base member, and said cushion made of a low friction material secured to the bottom of said base member to facilitate said sliding movement; two flexible friction plates secured to the top of elongated lateral portions of said base member, extending outwardly beyond lateral edges of said base ember, and said top cover member having elongated lateral portions protruding downwardly above said extending portions of said friction plates wherein by tilting said cover member, said downwardly protruding portion thereof presses against said extending portion of said friction plate to engage thereof with said platform to stop said sliding movement.

4. A ski slalom exerciser according to claim 3 wherein two adjacent elongated guides are positioned and extend above said platform with forward ends pivotally secured to bracket means displaced forwardly in variable distance from said platform to vary the angle of pivotal movement of said guides, and a stem of said bracket means being removably mounted in selected positions to a front cross brace of said base; the middle portions of said guides extending into center openings of said sliders and slidably engaging thereof to guide said sliding movement, and to select a desired length of said sliding movement along said guides; restricting means removably mounted in selected positions on said guides at both ends of each slider; rear portions of said guides being removably coupled with a stretchable tether to keep said guides and said sliders in a close an parallel configuration.

5. A ski slalom exerciser according to claim 4 further comprising a pair of stretchable straps with one end removably attached proximate to the forward end portions of said sliders and the other end embracing the knees of user, and said strap further comprising conventional buckles to vary the size of the embracing loop and the length of said strap between the knee and the sliders.

6. A ski slalom exerciser according to claim 5 wherein said base further comprises two spaced elongated tubular members having in their forward portions a plurality of openings for mounting a pair of upright poles in variable distance from said platform; each said pole comprising a support rod having an upper portion offset in a parallel relation to a lower portion to vary spacing between said poles, wherein a lower portion of a pipe member telescopically engages said upper portion of said support rod; and hand grips mounted to the upper end portions of said pipe member.

* * * * *